US007556047B2

(12) United States Patent
Poindexter et al.

(10) Patent No.: US 7,556,047 B2
(45) Date of Patent: Jul. 7, 2009

(54) METHOD OF EXPANDING TOBACCO USING STEAM

(75) Inventors: Dale Bowman Poindexter, East Bend, NC (US); Jack Gray Flinchum, Jr., King, NC (US); Franklin Allan Stump, Jr., Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 254 days.

(21) Appl. No.: 10/393,529

(22) Filed: Mar. 20, 2003

(65) Prior Publication Data

US 2004/0182404 A1 Sep. 23, 2004

(51) Int. Cl.
*A24B 3/18* (2006.01)

(52) U.S. Cl. ..... 131/296; 131/306

(58) Field of Classification Search ..... 131/296, 131/291, 306

See application file for complete search history.

(56) References Cited

U.S. PATENT DOCUMENTS

| | | | |
|---|---|---|---|
| 2,596,183 | A | 5/1952 | Sowa |
| 2,653,093 | A | 9/1953 | Baer |
| 2,759,858 | A | 8/1956 | Baer |
| 3,357,436 | A | 12/1967 | Wright |
| 3,409,022 | A | 11/1968 | de la Burdé |
| 3,409,027 | A | 11/1968 | de la Burdé |
| 3,524,451 | A | 8/1970 | Fredrickson |
| 3,524,452 | A | 8/1970 | Moser et al. |
| 3,529,606 | A | 9/1970 | de la Burdé et al. |
| 3,556,112 | A | 1/1971 | de la Burdé et al. |
| 3,575,178 | A | 4/1971 | Stewart |
| 3,683,937 | A | 8/1972 | Fredrickson et al. |
| 3,693,631 | A | 9/1972 | Moore et al. |
| 3,734,104 | A | 5/1973 | Buchanan et al. |
| 3,753,440 | A | 8/1973 | Ashburn |
| 3,771,533 | A | 11/1973 | Armstrong et al. |
| 3,788,331 | A | 1/1974 | Neel et al. |
| 4,167,191 | A | 9/1979 | Jewell et al. |
| 4,211,243 | A | 7/1980 | Ohno et al. |
| 4,235,249 | A | 11/1980 | Psaras et al. |
| 4,257,431 | A | 3/1981 | White |
| 4,270,553 | A | 6/1981 | Conrad et al. |

(Continued)

FOREIGN PATENT DOCUMENTS

| | | | |
|---|---|---|---|
| DE | 3130778 | A1 | 3/1983 |

(Continued)

OTHER PUBLICATIONS www.dictionary.com (website last updated on Jan. 26, 2005).*

(Continued)

*Primary Examiner*—Carlos Lopez
(74) *Attorney, Agent, or Firm*—Alston & Bird LLP

(57) ABSTRACT

A method of expanding tobacco involves introducing a steam flow and a tobacco material into a duct having an inlet and an outlet and defining an arcuate flow path. The tobacco is entrained in the steam flow and conveyed along the arcuate flow path and toward the outlet. The presence of the steam results in volumetric expansion of the tobacco as the steam and entrained tobacco travel along the flow path. The steam and entrained tobacco are then collected and separated. As such, an expanded tobacco is provided.

24 Claims, 1 Drawing Sheet

U.S. PATENT DOCUMENTS

| | | | | | |
|---|---|---|---|---|---|
| RE30,693 | E | | 8/1981 | Fredrickson | |
| 4,298,012 | A | | 11/1981 | Wochnowski | |
| 4,301,819 | A | | 11/1981 | Davies et al. | |
| 4,310,006 | A | | 1/1982 | Hibbitts et al. | |
| 4,315,515 | A | | 2/1982 | Mills, III | |
| 4,340,073 | A | | 7/1982 | de la Burde et al. | |
| 4,407,306 | A | * | 10/1983 | Hibbitts | 131/296 |
| 4,414,987 | A | | 11/1983 | Utsch et al. | |
| 4,418,706 | A | | 12/1983 | Kim et al. | |
| 4,458,700 | A | | 7/1984 | Keritsis et al. | |
| 4,459,100 | A | | 7/1984 | de la Burde et al. | |
| 4,460,000 | A | | 7/1984 | Steinberg | |
| 4,483,352 | A | | 11/1984 | Egri | |
| 4,485,829 | A | * | 12/1984 | Rainer et al. | 131/291 |
| RE31,816 | E | | 1/1985 | Wochnowski | |
| 4,513,758 | A | | 4/1985 | Henzelin et al. | |
| 4,523,598 | A | * | 6/1985 | Weiss et al. | 131/291 |
| 4,531,529 | A | | 7/1985 | White et al. | |
| 4,561,453 | A | | 12/1985 | Rothchild | |
| 4,646,760 | A | | 3/1987 | Egri | |
| 4,677,994 | A | | 7/1987 | Denier et al. | |
| 4,687,007 | A | | 8/1987 | Denier et al. | |
| 4,693,264 | A | | 9/1987 | Hedge | |
| 4,697,604 | A | | 10/1987 | Brown et al. | |
| 4,760,854 | A | | 8/1988 | Jewell et al. | |
| 4,844,101 | A | | 7/1989 | Hirsch et al. | |
| 5,060,670 | A | | 10/1991 | Egri | |
| 5,095,922 | A | | 3/1992 | Johnson et al. | |
| 5,095,923 | A | | 3/1992 | Kramer | |
| 5,259,403 | A | | 11/1993 | Guy et al. | |
| 5,339,837 | A | | 8/1994 | Hirsch et al. | |
| 5,379,780 | A | | 1/1995 | Uematsu et al. | |
| 5,865,187 | A | | 2/1999 | Fischer et al. | |
| 5,873,372 | A | | 2/1999 | Honeycutt et al. | |
| 5,908,032 | A | * | 6/1999 | Poindexter et al. | 131/291 |
| 5,947,128 | A | | 9/1999 | Adedeji | |
| 6,221,413 | B1 | | 4/2001 | Bichsel | |
| 6,499,489 | B1 | * | 12/2002 | Coleman, III | 131/309 |
| 2002/0189624 | A1 | | 12/2002 | Pluckhahn et al. | |
| 2004/0074506 | A1 | * | 4/2004 | Fleischhauer et al. | 131/294 |

FOREIGN PATENT DOCUMENTS

| | | | | | |
|---|---|---|---|---|---|
| EP | 0 514 860 | B1 | | 2/1997 | |
| WO | WO 0221947 | A1 | * | 3/2002 | 131/294 |

OTHER PUBLICATIONS

Browne, Colin L., The Design of Cigarettes, Celanese Fibers Marketing Company, 2nd Edition, p. 14, Feb. 1981.*

* cited by examiner

METHOD OF EXPANDING TOBACCO USING STEAM

FIELD OF THE INVENTION

The invention relates to tobacco, and in particular, to methods for processing tobacco suitable for use in manufacturing smoking articles.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in a so-called "blended" form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, volume expanded or "puffed" tobacco makes up a portion of the blend. See, for example, *Tobacco Encyclopedia*, Voges (Ed.) p. 419 (1984), Browne, *The Design of Cigarettes,* 3$^{rd}$ Ed., p.50 (1990) and *Tobacco Production, Chemistry and Technology*, Davis et al. (Eds.) (1999).

It is generally desirable to expand the volume of tobacco material, particularly cut filler, in order to increase filling capacity such that reduced weights of tobacco are incorporated into smoking articles. Certain processes directed toward increasing the filling capacity of tobacco have incorporated steam as a process component. See, for example, U.S. Pat. No. 3,529,606 to de la Burde; U.S. Pat. No. 4,4418,706 to Kim; U.S. Pat. No. 4,235,249 to Psaras; U.S. Pat. No. 4,407,306 to Hibbits; U.S. Pat. No. 4,211,243 to Ohno; U.S. Pat. No. 4,298,012 to Wochnowski; U.S. Pat. No. 4,414,987 to Utsch; U.S. Pat. No. 4,458,700 to Keritsis; U.S. Pat. No. 4,459,100 to de la Burde; U.S. Pat. No. 4,523,598 to Weiss; U.S. Pat. No. 4,687,007 to Denier; U.S. Pat. No. 4,693,264 to Hedge; U.S. Pat. No. 4,697,604 to Brown; and U.S. Pat. No. 4,844,101 to Hirsch. A number of known methods for expanding tobacco material involve impregnation of a tobacco material with volatile organic or inorganic compounds, such as halogenated hydrocarbons, iso-pentane, propane, ammonium carbonate or carbon dioxide ($CO_2$). See, for example, U.S. Pat. No. 3,524,451 to Fredrickson; U.S. Pat. No. 3,771,533 to Armstrong et al; U.S. Pat. No. 4,310,006 to Hibbits; U.S. Pat. No. 4,340,073 to de la Burde et al; U.S. Pat. No. 4,460,000 to Steinberg; U.S. Pat. No. 4,531,529 to White et al; U.S. Pat. No. 4,561,453 to Rothchild; U.S. Pat. No. 4,760,854 to Jewell; U.S. Pat. No. 5,095,922 to Johnson et al; and U.S. Pat. No. 5,095,923 to Kramer; and EPO 514860. Certain tobacco expansion processes have been designated as G-13, G-13C and Impex. The impregnated tobacco is subjected to a heat treatment process that rapidly vaporizes the impregnating compound, thereby expanding the strands of impregnated tobacco. Expansion processes involving the treatment of tobacco impregnated with solid $CO_2$ with heat are generally referred to in the art as dry ice expanded tobacco processes or "DIET" processes. Exemplary DIET processes are disclosed in U.S. Pat. No. 5,259,403 to Guy et al. and U.S. Pat. No. 5,908,032 to Poindexter et al; which are incorporated herein by reference.

Certain expansion processes that involve impregnating tobacco with expansion agents or compounds involve added process complexity and cost resulting from the need to impregnate the tobacco with those expansion agents and compounds. Such expansion processes typically require separate vessels designed to intimately mix the tobacco with the impregnating compound. In the case of the DIET process, the process apparatus must also be capable of withstanding pressure changes associated with the conversion of liquid $CO_2$ to dry ice following impregnation. Thus, it would be desirable to provide a simple and cost-effective tobacco expansion process that does not require impregnation of the tobacco material with an expansion agent or compound, such as $CO_2$.

SUMMARY OF THE INVENTION

The present invention relates to a method for increasing the filling power or filling capacity of tobacco. The method involves entrainment of a moist tobacco in a flowing stream of steam. The method does not involve any appreciable impregnation of the moist tobacco with volatile expansion agents or compounds, such as $CO_2$. Rather, the process only requires a mixture of steam and tobacco in order to appropriately process that tobacco. As a result, the method of the present invention can be more streamlined, cost effective, and less complex than certain other expansion processes.

The method involves providing a duct having an inlet and an outlet, the duct having an appropriate shape, and preferably defining an arcuate flow path. Steam is introduced into the inlet of the duct and a moist tobacco material is introduced into the duct downstream from the steam inlet. The moistened tobacco most preferably is substantially free of impregnated $CO_2$ or other impregnated volatile organic or inorganic compounds. The steam flow entering the duct has a sufficient temperature to cause expansion of the tobacco, as well as a sufficient flow rate and velocity to convey the tobacco through the duct. The tobacco is entrained in the steam flow. The steam and entrained tobacco are conveyed along the appropriate flow path defined by the overall shape of the duct, and toward the outlet region of the duct. As the tobacco travels through the duct, the steam can penetrate deeply into the tobacco structure and allowing internal stresses, such as folds and compactions within that tobacco, to relax. As such, the filling capacity of the tobacco is increased. The steam and expanded tobacco are collected from the outlet of the duct and separated from one another. As a result, the process steps provide for tobacco of increased filling capacity and smoking articles made using that processed tobacco.

BRIEF DESCRIPTION OF THE DRAWINGS

Figure 1:
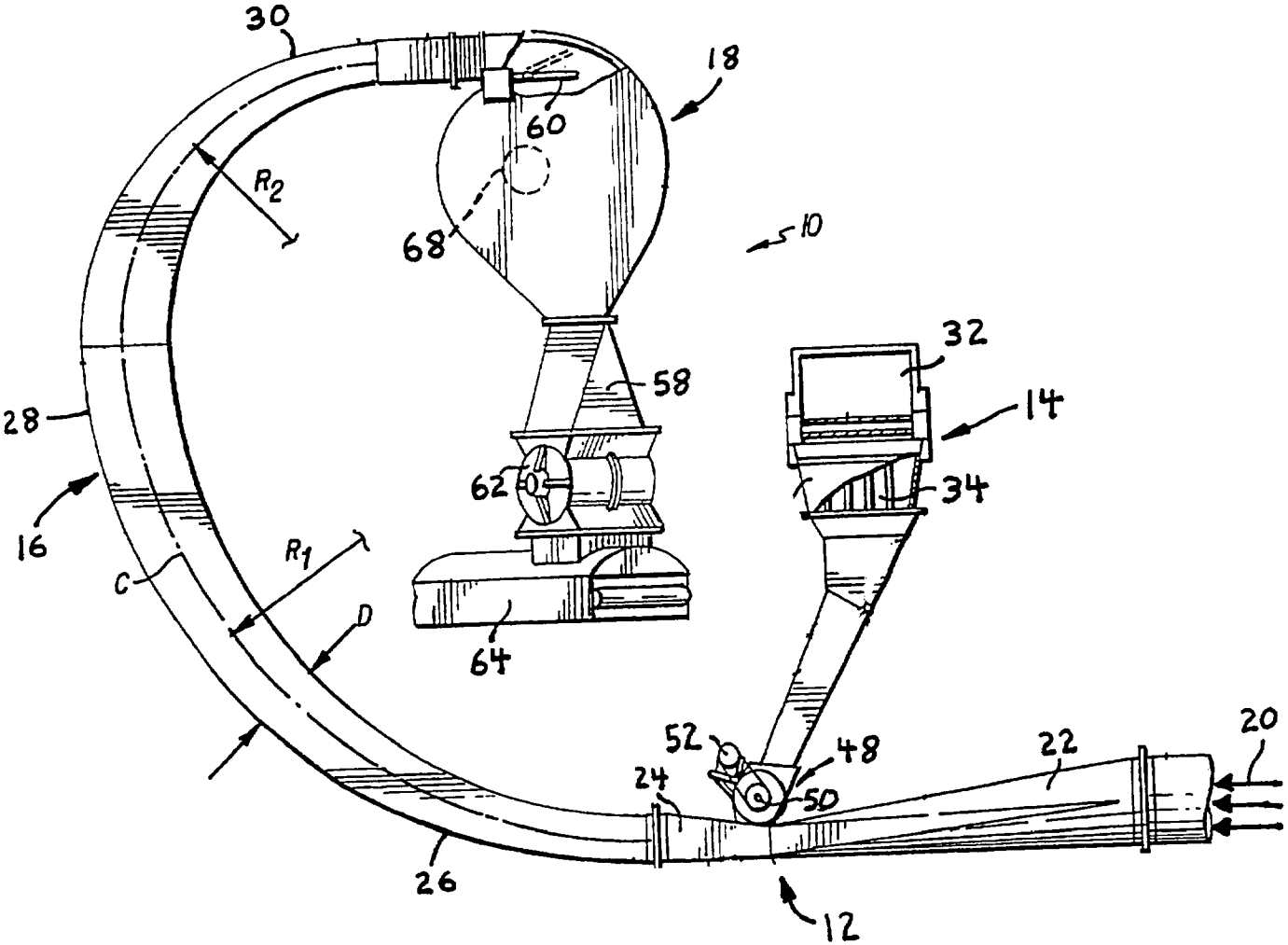

Having thus described the invention in general terms, reference will now be made to the accompanying FIG. 1, which is not necessarily drawn to scale, and which is a side elevation of an exemplary embodiment of an apparatus useful for practicing the method of the invention.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Exemplary tobacco expansion systems and equipment suitable for practicing the present invention are employed by R. J. Reynolds Tobacco Company in Winston-Salem, N.C. and by Japan Tobacco Inc. in Trier, Germany; and exemplary tobacco expansion systems and equipment are available under license from R. J. Reynolds Tobacco Company from Airco DIET, L.L.C. Exemplary tobacco expansion systems and equipment are set forth in U.S. Pat. No. 5,908,032 to Poindexter et al., which is incorporated herein by reference in its entirety.

An example of an apparatus suitable for practicing the method of the invention is described with reference to FIG. 1. A preferred apparatus 10 comprises a venturi section 12, a tobacco feeding device 14, an arcuate duct 16, and a separator 18. Such a representative apparatus is an apparatus suitable for use in carrying out the DIET process.

The apparatus 10 preferably includes a venturi section 12 that includes a venturi inlet tube 22 and a venturi outlet tube 24. The venturi section 12 serves to accelerate steam flow 20 towards the duct 16. A suitable heater (not shown) located upstream from the venturi section 12 can be used to adjust the temperature of the steam, as desired. Methods for producing steam and sources of steam will be readily apparent to those skilled in the art of carrying of DIET processing of tobacco.

The apparatus 10 can be designed so as to be absent of a venturi section 12. That is, for an apparatus having a sufficiently high flow rate of steam, and an inlet tube 22 and/or outlet tube 24 of sufficiently small size, the venturi section 12 can be optional. As such, it is possible for the inlet tube to have an essentially constant cross-sectional shape and size throughout that region defined by the inlet tube 22, the outlet tube 24 and the inlet region 26.

The tobacco feeding device 14 preferably includes a hopper 32 that includes a plurality of vertical diversion baffles 34 for spreading a tobacco material across the width of the hopper. The tobacco is suitably introduced into an inlet section 26 of the duct 16 using a rotary air lock 48 (e.g., a winnower device) comprising a rotary shaft 50 and an associated motor 52 suitably connected and mounted in association therewith. The winnower, which rotates at a relatively high speed, is capable of accelerating the tobacco material across substantially the entire depth of the steam flow 20 passing from the venturi section 12 and into the inlet section 26.

The duct 16 preferably is arcuate in side elevation, preferably substantially semicircular in side elevation. For the arcuate duct shown, the centerline C is defined by two large radii, $R_1$ and $R_2$, that form the arcuate flow path. Each of $R_1$ and $R_2$ is preferably about 6 to about 20 feet, more preferably about 8 to about 15 feet, although larger or smaller radii can be used. The substantially horizontal inlet section 26, the substantially vertical intermediate section 28, and the substantially horizontal outlet section 30, are in fluid communication such that the steam and entrained tobacco may be conveyed through the duct. See, U.S. Pat. No. 5,908,032 to Poindexter et al., which is incorporated herein by reference in its entirety. In addition to arcuate duct 16, the duct can have other shapes and configurations suitable for carrying out the DIET process. For example, rather than having an arcuate or rounded generally "C" shape, the duct can have a somewhat squared or rectangular "C" shape, generally "S" or "Z" shapes, or the shape of an arch (e.g., an arch having the general shape of a forward "S" or "Z" shaped duct connecting to a backward "S" or "Z" shaped duct. However, it is preferred that the duct have a larger cross-sectional area toward the center region of the duct relative the respective inlet and outlet ends of that duct.

It is preferable to provide a duct 16 that provides for a suitable flow of tobacco therethrough. The duct 16 most preferably is designed so as to have a size and shape suitable for allowing tobacco that is introduced therein to travel in an overall generally consistent direction through that duct by the fluid (i.e., steam) that flows through that duct. It is preferred that the flow of the steam be sufficient to convey the tobacco adequately through the duct so that the tobacco moves consistently at a desirable rate in the overall direction that the steam flows. It is preferable that the relationship of the flow of steam and the shape of the duct 16 are such that the tobacco does not experience undue or excessive contact with the walls of the duct, and it is preferable that the tobacco not experience undue or excessive turbulent movement within the duct. It is preferred that the tobacco be handled in a relatively gentle fashion within the duct. That is, it is preferred that the tobacco not experience an overall "round-and-round" suspension or juggling-type of movement in the duct, and that the tobacco not be suspended within the duct in so-called "eddy" types of currents, and the tobacco does not experience the overall propensity to "recycle back" within the duct and the stream of steam; but rather that the tobacco travel in an overall consistently forward manner through the duct in the overall dominant direction of the flow of the steam. As such, the residence time of the tobacco within the duct 16 can be well controlled, the tobacco is contacted with tobacco long enough to provide an increase in filling capacity thereof, the tobacco is not overheated or excessively traumatized, and the time that the tobacco is exposed to the steam within the duct is neither too short nor too long.

It is preferred that the steam flow 20 enter the duct 16 at a sufficient temperature to relax the structure of the tobacco material and to cause expansion of the tobacco material. Typically, the steam is supplied at a sufficient mass flow rate and velocity to convey the tobacco through the duct. Steam preferably enters the duct at a temperature of about 400 to about 800° F., more preferably at a temperature of about 600 to about 700° F. The velocity of the steam through the duct is preferably 7,000 to about 15,000 feet per minute (fpm) of steam flow, more preferably about 8,000 to about 13,000 fpm, most preferably about 9,000 to about 12,000 fpm, at the entrance to the duct (i.e., at the venturi 12). The velocity of the steam decreases as the steam passes through the substantially vertical section of the duct (i.e., duct section 28). Typically, the velocity of the steam as it passes through the substantially vertical section of the duct is about 1,500 to about 5,000 fpm, more preferably about 2,000 to about 4,000 fpm, most preferably about 2,500 to about 3,500 fpm. The mass flow rate of the steam through the arcuate duct can vary depending on the scale of the process. Larger sized ducts designed to transport larger amounts of tobacco require appropriately larger mass flow rates of steam.

It is preferred that the tobacco be entrained within a steam flow 20 and conveyed through an arcuate duct 16 having an inlet and an outlet. By "arcuate" is meant that the duct defines a flow path that varies the direction of flow substantially continuously from the inlet to the outlet. Preferably, the arcuate duct is substantially semicircular in side elevation. The duct preferably comprises a substantially horizontal inlet section, a substantially vertical intermediate section in fluid communication with the inlet section, and a substantially horizontal outlet section in fluid communication with the intermediate section. The arcuate flow path provided by the duct avoids abrupt flow direction changes caused by sharply angled duct sections, which can apply physical and mechanical stresses to the tobacco, resulting in crimping, breakage and compaction of the tobacco strands. The arcuate flow path minimizes stresses on the tobacco and provides substantially non-turbulent flow through the duct. The substantially vertical section of the duct allows for the suspension of the tobacco in the moving stream of steam, and provides for aid in freeing each piece of tobacco of internal stresses while freeing each piece of tobacco from external stresses.

In one preferred embodiment, the arcuate duct 16 has a non-circular cross-section, such as a rectangular cross-section, with a high width-to-depth (W/D) ratio of about 5:2. A high W/D ratio reduces the velocity gradient across the depth of the duct cross-section so that the flow through the duct is substantially uniform at any given cross section. The duct also preferably has a gradually diverging (i.e. increasing) depth, D, from the inlet to the intermediate section of the duct and a gradually converging (i.e. decreasing) depth from the intermediate section to the outlet section. The increasing depth in the inlet section of the duct causes the flow velocity to drop smoothly and uniformly from the inlet section to the substantially vertical intermediate section, which increases the residence time within the duct in order to ensure that the tobacco remains in the duct for a time sufficient to expand the tobacco. The use of a gradually converging depth from the intermediate section to the outlet serves to accelerate the expanded tobacco as it exits the duct and enters a separation apparatus.

Typically, the residence time of the tobacco in the duct 16 is about 1 to about 8 seconds, usually about 3 to about 5 seconds, on average.

The steam and entrained tobacco exits the duct 16 and enters a separator 18. Preferably, the separator 18 is a tangential separator having an adjustable baffle 60 pivotally mounted adjacent to the separator inlet. Any separation process known in the art can be used to separate the steam and expanded tobacco from one another. Preferably, the steam and tobacco are separated using a tangential separator, a low velocity cyclone separator, or other suitable techniques and equipment familiar to those skilled in the art of tobacco processing. Typically, the tobacco entering the duct undergoes an initial acceleration upwards followed by deceleration (e.g., an overall deceleration in its overall forward movement through the duct from the time that the tobacco is entrained in the stream of steam upon introduction into the duct until the time that the tobacco reaches the outlet end of the duct). The tobacco then can be accelerated slightly so as to provide for adequate removal of that tobacco from the duct. The expanded tobacco product is forced radially outwardly in the separator 18 and eventually falls into collection chute 58. From the collection chute 58, the tobacco material can pass through a rotary air lock 62 and onto a conveyor 64 for cooling prior to reordering. Steam exits the separator 18 by a steam return duct 68. The steam duct 68 is preferably vented to atmosphere and a fan (not shown) is preferably in fluid connection with the steam duct 68 downstream from the separator 18. The fan is used to control the velocity of the steam and entrained tobacco conveyed through the duct 16. The flow of steam can be single-pass in nature, and can be forced or induced; or the flow of steam can be recirculated with appropriate waste-gas bleed off. The steam and entrained tobacco are collected and separated after exiting the arcuate duct. The steam expansion gas may be reheated and used again via recirculation. Any desirable fraction of the steam may be removed from the expansion gas recirculation circuit and made up with fresh steam.

The apparatus 10 can be employed by suitably altering an existing apparatus used to carry out the DIET process, or the apparatus can be designed specifically to carry out the present invention. In situations in which an apparatus designed for carrying out the DIET process is used, certain components used specifically for carrying out the DIET process can be disengaged, by-passed or removed. For example, typical DIET process components used for $CO_2$ impregnation, frozen tobacco declumping, frozen tobacco storage and $CO_2$ recovery can be disengaged, by-passed or removed. As such, it is not necessary to employ those so-called "cold end" components that are used to carry out the DIET process using the apparatus.

Various types of tobacco can be used in carrying out the present invention. The tobacco typically is burley, flue-cured or Oriental tobacco. Other tobaccos that can be used in carrying out the present invention, include, but are not limited to, tobaccos such as Maryland, dark, dark-fired and Rustica tobaccos, as well as other rare or specialty tobaccos. See, for example, Akehurst, *Tobacco* (1968) and Tso, *Production, Physiology, and Biochemistry of Tobacco Plant* (1990). Various types of tobaccos are described greater detail in U.S. patent application Ser. No. 10/285,395, filed Oct. 31, 2002, which is incorporated herein by reference. The tobacco used in the invention can comprise a single type of tobacco, or a blend of two or more types of tobacco. Preferably, the types of tobacco that are processed are burley tobacco, flue-cured tobacco, or blends thereof.

The physical form of the tobaccos that are processed can vary. Most preferably, the tobacco materials are those that have been appropriately cured and aged. The tobacco material can be in whole leaf form, in the form of lamina or strip, or in shredded or cut filler form. Though less preferred, portions of the tobacco used in the invention can have a processed form, such as processed tobacco stems (e.g., cut stems or cut-rolled stems) or reconstituted tobacco (e.g., reconstituted tobaccos manufactured using paper-making type or cast sheet type processes, preferably in strip or cut filler form). The tobacco used in the invention may further include tobacco waste materials, such as fines, dust, scrap and stem; and those materials can be further used for the manufacture of processed tobaccos. Most preferably, the tobaccos are used in forms, and in manners, that-are traditional for the blending of tobaccos for use as cut filler for the manufacture of smoking articles, such as cigarettes. It is most preferred that the tobacco be in the form of lamina (e.g., tobacco leaf lamina that has been separated from tobacco stem) that has been cut into a cut filler form. For example, the tobacco that is processed can have the form of flue-cured tobacco cut filler, burley tobacco cut filler, or a blend thereof. See, U.S. Pat. No. 5,095,922 to Johnson et al. and U.S. Pat. No. 5,259,403 to Guy et al., which are incorporated herein by reference in their entireties.

The tobacco material most preferably is in a moistened form during processing. The tobacco typically possesses a moisture content, prior to treatment in accordance with the present invention, of about 10 to about 40 percent, preferably about 15 to about 30 percent, and more preferably about 18 to about 26 percent, based on the total weight of the tobacco mixture. By introducing moistened tobacco (e.g., tobacco having added water so as to have a moisture content of about 25 to about 30 weight percent), it is possible to provide a processed tobacco having a moisture content of about 12 weight percent. Processed tobacco having a moisture content of less than about 12 weight percent (or any other desired moisture content) can be further processed so as to possess a desired moisture content using the types of re-ordering techniques and equipment that are well known to those skilled in the art of tobacco processing.

The method for achieving the desired moisture content in the various tobacco materials used in carrying out the present invention can vary. For example, an aqueous liquid, such as water, can be sprayed on, and subsequently absorbed by the tobacco materials. Alternatively, the tobacco materials can also be subjected to a humid environment, or dipped into the liquid to absorb the desired amount of moisture. The water can be essentially pure water, and can be processed so as to have a controlled degree of purity, such as is the case for de-ionized water or tap water. The moisture content can also be reached by spreading onto the tobacco materials that are typical components of casing-type solutions or top dressing-type solutions, or other liquids such as buffers, solvents, or solutions containing materials extraneous to natural tobacco materials. Preferably, the moisture is dispersed throughout the tobacco, and as such, the tobacco can be considered to be impregnated with water. Manners and methods (e.g., the use of drum and tunnel types of equipment) for moistening tobacco materials and blends of tobacco materials, such as tobacco materials that are being prepared for treatment using volume expansion equipment and processing steps, will be readily apparent to those skilled in the art of tobacco processing.

The tobacco material that is contacted with the steam most preferably has a temperature approximating that of ambient temperature. Although it is not strictly necessary to provide the tobacco at a particular temperature, it is possible to heat or cool the tobacco to a temperature higher or lower than normal ambient temperatures.

The tobacco used in the invention is substantially free of impregnating volatile compounds other than steam. In other words, the tobacco is substantially free, and preferably completely free, of added components such as added ammonia-containing compounds, carbon dioxide, and volatile organic compounds (e.g., hydrocarbons and halogenated hydrocarbons). That is, tobacco that is processed using steam is not purposefully impregnated with other agents that are used to facilitate expansion of the tobacco. As used herein, the term "consisting essentially of", when applied to the tobacco material used in the process of the present invention, refers to a moist tobacco material free from volatile organic or inorganic impregnating compounds, other than water, used in the art of tobacco expansion.

The steam flow preferably is virtually free of air, meaning the steam flow is composed of approximately 100 percent steam by weight. The steam flow also can be substantially free of air, meaning that the steam flow is composed of at least about 95 percent steam, by weight. However, a flow of steam comprising about 50 to about 100 percent steam by weight, preferably about 85 to about 100 percent, may be used without departing from the present invention. Other components that can be mixed with the steam include atmospheric air. The steam preferably enters the duct at approximately atmospheric pressure and the overall pressure in the duct typically remains at approximately atmospheric pressure throughout the treatment process.

The amount of steam that is employed relative to the amount of tobacco can vary, but the weight of the steam that is employed is greater than the dry weight of the tobacco that is processed using that steam. Typically, the amount (i.e., weight) of steam that is used to process the tobacco is at least about 6, preferably at least about 7 and most preferably about 8 times that amount dry tobacco that is processed using that steam. Typically, the amount of steam that is used to process the tobacco does not exceed about 15 times, and preferably does not exceed about 10 times that of the dry tobacco that is processed using that steam.

Typically, the temperature of the tobacco that is processed using steam in accordance with the process of the present invention preferably does not exceed about 350° F. In certain instances, the tobacco that is processed does not experience being heated to a temperature in excess of about 300° F., and often does not experience being heated to a temperature in excess of about 250° F. Tobacco exiting the duct often exhibits a temperature in the range of about 225 to about 275° F. In circumstances in which the tobacco has been moistened to have a moisture content of about 25 to about 30 weight percent, the temperature of the tobacco that is processed using steam does not exceed a temperature within the range of about 160 to about 200° F.

As the steam and entrained tobacco travel through the duct, the steam relaxes and expands the tobacco by penetrating deeply into the tobacco, which relieves stresses (e.g., folds, compactions, etc.) within the tobacco material. The hot steam provides energy to heat the tobacco particles and rapidly vaporize water within the tobacco particles. As a result, the filling capacity of the tobacco treated according to the method of the invention is increased at least about 10 percent, more preferably at least about 20 percent, most preferably at least about 30 percent. However, as a result, the filling capacity of the tobacco treated according to the method of the invention normally is not increased by more than about 50 percent, and frequently is not increased by more than about 40 percent. In situations in which the tobacco is in shredded or cut filler form, interaction of those tobacco pieces or strands with the steam also can have the effect of causing straightening of the tobacco pieces or strands.

By using steam rather than air, the thermodynamic characteristics and properties of the fluid within the duct can be substantially changed. At atmospheric pressure, the density of steam at a nominal 500° F. is 38.77 cubic feet per pound, air is 24.2 cubic feet per pound, and $CO_2$ is 15.9 cubic feet per pound. The specific heat capacity of dry air is about 0.24 BTU per pound per degree F., and that of steam is about 1.0 BTU per pound per degree F. At atmospheric pressure, this results in specific energy capacity per unit volume for air of 0.01 BTU per cubic foot per degree F., and for steam of 0.026 BTU per cubic foot per degree F. At 500° F., the viscosity of dry air is about $19.0\times10^6$ pounds per square foot, and that of steam is about $12.2\times10^6$ pounds per square foot.

The method for measuring the extent of volumetric expansion (i.e., the increase in filling capacity) of the tobacco can vary. Preferably, the method of measuring the filling capacity of the tobacco material involves placing a tobacco sample of known weight in a cylinder, applying a known pressure to the tobacco sample in the cylinder, and thereafter measuring the volume of the compressed sample. The filling capacity of the tobacco can then be expressed in terms of volume per weight, such as cubic centimeters per 100 grams of tobacco cut filler. See, U.S. Pat. No. 5,095,922 to Johnson et al., which is incorporated herein by reference in its entirety.

The tobacco materials so processed can be blended with other tobacco materials. Those tobacco materials also can be combined with other components such as those that are traditionally used in the tobacco industry. Such other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

Tobacco materials processed according to the process steps of the present invention can be used for the manufacture of tobacco products, and most preferably, smoking articles, such as cigarettes. If desired, the treated tobacco blend can be subjected to a reordering treatment to increase the moisture content prior to use in smoking article manufacturing. Typically, the moisture level of the expanded tobacco is adjusted to between about 11 and about 12 weight percent based on the total weight of the expanded tobacco material. The amount of the treated tobacco employed per smoking article can vary, and for cigarettes, the total amount of tobacco material typically ranges from about 0.6 g to about 1 g per rod. Representative tobacco blends, representative cigarette components, and representative cigarettes manufactured therefrom, are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; US Pat. Application 2002/0000235 to Shafer et al.; and PCT WO 02/37990. Those tobacco materials also can be employed for the manufacture of those types of cigarettes that are described in U.S. Pat. No. 4,793,365 to Sensabaugh; U.S. Pat. No. 4,917,128 to Clearman et al.; U.S. Pat. No. 4,947,974 to Brooks et al.; U.S. Pat. No. 4,961,438 to Korte; U.S. Pat. No. 4,920,990 to Lawrence et al.; U.S. Pat. No. 5,033,483 to Clearman et al.; U.S. Pat. No. 5,074,321 to Gentry et al.; U.S. Pat. No. 5,105,835 to Drewett et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,247,949 to Deevi et al.; U.S. Pat. No. 5,551,451 to Riggs et al.; U.S. Pat. No. 5,285,798 to Banerjee et al.; U.S. Pat. No. 5,593,792 to Farrier et al.; U.S. Pat. No. 5,595,577 to Bensalem et al.; U.S. Pat. No. 5,816,263 to Counts et al.; U.S. Pat. No. 5,819,751 to Barnes et al.; U.S. Pat. No. 6,095,153 to Beven et al.; U.S. Pat. Nos. 6,311,694 to Nichols et al.; and 6,367,481 to Nichols, et al.; and PCT WO 97/48294 and PCT WO 98/16125. See, also, those types of commercially marketed cigarettes described *Chemical and Biological Studies on New Cigarette Prototypes that Heat Instead of Burn Tobacco*, R. J. Reynolds Tobacco Company Monograph (1988) and *Inhalation Toxicology,* 12:5, p. 1-58 (2000).

The tobacco expansion process described herein provides an advantageous manner or method for efficiently and effectively increasing the filling capacity of tobacco materials. The process can be carried out using commercially available equipment designed to perform the DIET process, and any modifications to that equipment can be readily provided. The process can be carried out using a readily available and chemically simple material; that is, steam. The process does not require impregnating the tobacco with $CO_2$ or volatile organic compounds (e.g., halogenated hydrocarbons, isopentane or propane). Thus, the complexity of the tobacco expansion process is reduced, and the possibility of impregnating compounds causing adverse changes to the flavor and aroma of the tobacco (and smoke produced thereby) is eliminated. The process does not require subjecting the tobacco to extremely low temperature, such as when tobacco impregnated with $CO_2$ is frozen in the carrying out of the DIET process. That is, the tobacco is exposed to a less extreme temperature gradient than is traditional when carrying out the DIET process. For example, for DIET processes, the tobacco impregnated with solid $CO_2$ has a temperature of approximately −109° F., prior to being subjected to sublimation conditions. During sublimation, the tobacco impregnated with $CO_2$ is subjected to contact with a gas having a temperature of about 400 to about 800° F. Thus, the tobacco is exposed to a temperature gradient of about 500 to about 900° F. In contrast, the tobacco that is processed using steam in accordance with the present invention is not necessarily provided in a temperature controlled (e.g., very cold or frozen form); and can have a temperature approximating that of ambient temperature (i.e., about 50 to about 100° F., preferably about 75° F.) prior to contact with steam. Typically, the steam that contacts the tobacco has a temperature of about 400 to about 800° F., and as such, the tobacco is exposed to a temperature gradient of only about 325 to about 725° F.; meaning the difference between the temperature of the steam entering the duct and the temperature of the tobacco entering the duct is only about 325 to about 725° F. At any given gas temperature, the difference in the temperature gradient experienced by the tobacco in carrying out the process of the invention and the temperature gradient experienced by the $CO_2$ impregnated tobacco in a DIET process is about 180 to about 190° F. Preferably, the temperature gradient experienced by the tobacco in accordance with the invention is about 525 to about 625° F. Exposing the tobacco to a less extreme temperature gradient can reduce the possibility of causing undesirable chemical changes to the tobacco that adversely affect taste and aroma associated with that tobacco and the smoke generated thereby. Furthermore, tobacco treated in accordance with the invention can experience a slight reduction in nicotine content (e.g., by at least about 10 weight percent).

EXPERIMENTAL

The following examples are given to illustrate the invention, but should not be considered in limitation of the invention. Unless otherwise noted, all parts and percentages are by weight.

Example 1

A pilot scale expansion system was constructed. The expansion system is a one-seventy-fifth (1/75) scale sublimator system, and was constructed based on the geometry of the C-loop technology of R. J. Reynolds Tobacco Company that is of the type set forth in U.S. Pat. No. 5,908,032 to Poindexter et al. The pilot scale expansion system is described with reference to FIG. 1. Dimensions of curvature radii and overall height are essentially the same as in the full-scale C-loop system. Cross-sectional areas are proportionately the same so as to maintain the same gas velocities in equivalent locations within the C-Loop. To achieve 1/75th scale of the commercial C-Loop system, the pilot scale sublimator was constructed 3 inches wide with depths as follows: 2 inches at the tobacco inlet; 7 inches in the widest midpoint in the C as it becomes vertical; and 3.5 inches entering a tangential separator. The sublimator duct is non-circular in cross-sectional shape.

Burley tobacco cut filler having a moisture content of 20% was entrained into a steam flow and the tobacco and steam were conveyed through a substantially semicircular duct and separated in a tangential separator. The temperature of the steam flow was 450° F. and the mass flow rate of the steam was 615 lbs/hr. The steam treatment process increases the filling capacity of the tobacco so processed by 23%.

Example 2

Burley tobacco is processed in essentially the same manner as set forth in Example 1, except the initial temperature of the steam flow was 525° F. The steam treatment process increases the filling capacity of the tobacco so processed by 22%.

Example 3

Burley tobacco is processed in essentially the same manner as set forth in Example 1, except the initial temperature of the steam flow was 650° F. The steam treatment process increases the filling capacity of the tobacco so processed by 30%.

Example 4

A cut filler blend of burley, flue-cured and Oriental tobacco having a moisture content of 20% was entrained into a steam flow and the tobacco and steam were conveyed through a substantially semicircular duct and separated in a tangential separator. The temperature of the steam flow was 450° F. and the mass flow rate of the steam was 615 lbs/hr. The steam treatment process increases the filling capacity of the tobacco so processed by 11%.

Example 5

Tobacco is processed in essentially the same manner as set forth in Example 4, except the initial temperature of the steam flow was 525° F. The steam treatment process increases the filling capacity of the tobacco so processed by 15%.

Example 6

Tobacco is processed in essentially the same manner as set forth in Example 4, except the initial temperature of the steam flow was 650° F. The steam treatment process increases the filling capacity of the tobacco so processed by 27%.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for increasing the filling capacity of tobacco, comprising:

providing a duct having an inlet and an outlet and defining a flow path, wherein the flow path is an arcuate flow path that is substantially semicircular in shape from inlet to outlet, when viewed from a side elevation, and the duct comprises a substantially horizontal inlet section, a substantially vertical intermediate section in fluid communication with the inlet section, and a substantially horizontal outlet section in fluid communication with the intermediate section;

introducing a steam flow into the inlet of the duct, the steam flow having a sufficient temperature to increase the filling capacity of the tobacco and a sufficient flow rate and velocity to convey tobacco through the duct, wherein the steam flow comprises about 85 to about 100 percent steam by weight;

introducing a moist tobacco material into the duct downstream from the inlet, wherein the moist tobacco is free from volatile organic or inorganic impregnating compounds other than water, and wherein the moisture content of the tobacco is adjusted to between about 18 and about 26 weight percent based on the total weight of the tobacco prior to introducing the tobacco in the duct;

entraining the tobacco in the steam flow;

conveying the steam and entrained tobacco along the flow path and toward the outlet, the tobacco undergoing an increase in its filling capacity as the steam and entrained tobacco travel along the flow path;

collecting steam and entrained tobacco having increased filling capacity from the outlet of the duct; and separating the steam from the tobacco so collected, wherein tobacco collected from the duct has a filling capacity that is at least about 10% greater than that of the tobacco introduced into the duct.

2. The method of claim 1, wherein the tobacco is tobacco lamina or cut filler form.

3. The method of claim 1, wherein the tobacco is selected from the group consisting of burley tobacco, flue-cured tobacco, Oriental tobacco, and blends thereof.

4. The method of claim 2, wherein the tobacco is selected from the group consisting of burley tobacco, flue-cured tobacco, and blends thereof.

5. The method of claim 1, wherein the steam introduced into the duct has a temperature of about 400 to about 800° F.

6. The method of claim 1, wherein the steam introduced into the duct has a temperature of about 600 to about 700° F.

7. The method of claim 1, wherein the steam introduced into the duct has a velocity of about 7,000 to about 15,000 fpm.

8. The method of claim 1, wherein the steam introduced into the duct has a velocity of about 8,000 to about 13,000 fpm.

9. The method of claim 1, wherein the steam introduced into the duct has a velocity of about 9,000 to about 12,000 fpm.

10. The method of claim 1, wherein the velocity of the steam in the substantially vertical intermediate section of the duct is about 1,500 to about 5,000 fpm.

11. The method of claim 1, wherein the velocity of the steam in the substantially vertical intermediate section of the duct is about 2,000 to about 4,000 fpm.

12. The method of claim 1, wherein the velocity of the steam in the substantially vertical intermediate section of the duct is about 2,500 to about 3,500 fpm.

13. The method of claim 1, further comprising adjusting the moisture content of the tobacco having increased filling capacity to between about 11 and about 12 percent by weight, based on the total weight of that tobacco after separation from the steam.

14. The method of claim 1, further comprising cutting the tobacco to form cut filler form prior to introducing the tobacco into the duct.

15. The method of claim 1, wherein the duct is defined by two radii, each radius being about 6 to about 20 feet.

16. The method of claim 1, wherein the duct is defined by two radii, each radius being about 8 to about 15 feet.

17. The method of claim 1, wherein tobacco collected from the duct has a filling capacity that is at least about 20% greater than that of the tobacco introduced into the duct.

18. The method of claim 1, wherein tobacco collected from the duct has a filling capacity that is at least about 30% greater than that of the tobacco introduced into the duct.

19. A method for increasing the filling capacity of tobacco, comprising:

providing a duct having an inlet and an outlet and defining an arcuate flow path that is substantially semicircular in shape from inlet to outlet, when viewed from a side elevation, the arcuate flow path comprising a substantially horizontal inlet section, a substantially vertical intermediate section in fluid communication with the inlet section, and a substantially horizontal outlet section in fluid communication with the intermediate section;

introducing a steam flow into the inlet of the duct, the steam flow comprising about 85 to about 100 percent steam by weight, wherein the steam enters the duct at a temperature of about 400 to about 800° F. and a velocity of about 7,000 to about 15,000 fpm;

introducing a moist tobacco material into the duct downstream from the inlet, wherein the moist tobacco is free from volatile organic or inorganic impregnating compounds other than water, and wherein the moisture content of the tobacco is adjusted to between about 18 and about 26 weight percent based on the total weight of the tobacco prior to introducing the tobacco in the duct;

entraining the tobacco in the steam flow;

conveying the steam and entrained tobacco along the flow path and toward the outlet, the steam expanding the tobacco as the steam and entrained tobacco travel along the flow path;

collecting the steam and entrained expanded tobacco from the outlet of the duct;

separating the steam from the expanded tobacco, wherein the expanded tobacco has a filling capacity that is at least about 10% greater than that of the tobacco introduced into the duct; and incorporating the expanded tobacco into a smoking article.

20. The method of claim 19, wherein the moist tobacco material enters the duct at ambient temperature.

21. The method of claim 1, wherein the residence time of the tobacco in the duct is about 1 to about 8 seconds.

22. The method of claim 19, wherein the residence time of the tobacco in the duct is about 1 to about 8 seconds.

23. A method for increasing the filling capacity of tobacco, comprising:

providing a duct having an inlet and an outlet and defining a flow path, wherein the flow path is an arcuate flow path that is defined by two radii from inlet to outlet, when viewed from a side elevation, and the duct comprises a substantially horizontal inlet section, a substantially vertical intermediate section in fluid communication with the inlet section, and a substantially horizontal outlet section in fluid communication with the intermediate section;

introducing a steam flow into the inlet of the duct, the steam flow having a sufficient temperature to increase the filling capacity of the tobacco and a sufficient flow rate and velocity to convey tobacco through the duct, wherein the steam flow comprises about 85 to about 100 percent steam by weight;

introducing a moist tobacco material into the duct downstream from the inlet, wherein the moist tobacco is free from volatile organic or inorganic impregnating compounds other than water, and wherein the moisture content of the tobacco is adjusted to between about 18 and about 26 weight percent based on the total weight of the tobacco prior to introducing the tobacco in the duct;

entraining the tobacco in the steam flow;

conveying the steam and entrained tobacco along the flow path and toward the outlet, the tobacco undergoing an increase in its filling capacity as the steam and entrained tobacco travel along the flow path;

collecting steam and entrained tobacco having increased filling capacity from the outlet of the duct; and separating the steam from the tobacco so collected, wherein the collected tobacco has a filling capacity that is at least about 10% greater than that of the tobacco introduced into the duct.

24. A method for increasing the filling capacity of tobacco, comprising:

providing a duct having an inlet and an outlet and defining an arcuate flow path that is defined by two radii from inlet to outlet, when viewed from a side elevation, the flow path comprising a substantially horizontal inlet section, a substantially vertical intermediate section in fluid communication with the inlet section, and a substantially horizontal outlet section in fluid communication with the intermediate section;

introducing a steam flow into the inlet of the duct, the steam flow having a sufficient temperature to expand tobacco and a sufficient flow rate and velocity to convey tobacco through the duct, wherein the steam flow comprises about 85 to about 100 percent steam by weight;

introducing a moist tobacco into the duct downstream from the inlet, wherein the moist tobacco is free from volatile organic or inorganic impregnating compounds other than water and wherein the moisture content of the tobacco is adjusted to between about 18 and about 26 weight percent based on the total weight of the tobacco prior to introducing the tobacco in the duct;

entraining the tobacco in the steam flow;

conveying the steam and entrained tobacco along the flow path and toward the outlet, the steam expanding the tobacco as the steam and entrained tobacco travel along the flow path;

collecting the steam and entrained expanded tobacco from the outlet of the duct; and separating the steam from the expanded tobacco, wherein the expanded tobacco has a filling capacity that is at least about 10% greater than that of the tobacco introduced into the duct.

* * * * *